United States Patent [19]

Seino

[11] Patent Number: 4,465,439

[45] Date of Patent: Aug. 14, 1984

[54] MAGNETICALLY-COUPLED RECIPROCATING PUMP

[75] Inventor: Tadashi Seino, Morioka, Japan

[73] Assignee: Tohoku Mikuni Kogyo Co., Ltd., Iwate, Japan

[21] Appl. No.: 189,656

[22] Filed: Sep. 22, 1980

[30] Foreign Application Priority Data

Oct. 25, 1979 [JP] Japan ..... 54-138093

[51] Int. Cl.[3] ..... F04B 17/00

[52] U.S. Cl. ..... 417/417

[58] Field of Search ..... 417/374, 416, 417, 418, 417/540, 542, 410, 420; 192/84 PM; 91/DIG. 4; 310/103, 104, 80, 74

[56] References Cited

U.S. PATENT DOCUMENTS

| | | | |
|---|---|---|---|
| 2,528,415 | 10/1950 | Boorse | 417/418 |
| 2,978,990 | 4/1961 | Lewis | 417/542 |
| 3,119,341 | 1/1964 | Hirano et al. | 417/418 |
| 3,224,377 | 12/1965 | Hicks | 417/542 |
| 3,282,220 | 11/1966 | Inman | 417/418 |
| 3,303,787 | 2/1967 | Inman | 417/418 |
| 3,899,703 | 8/1975 | Kinnison | 310/103 |
| 4,231,722 | 11/1980 | Teichmann | 417/418 |
| 4,299,544 | 11/1981 | Masaka | 417/417 |

FOREIGN PATENT DOCUMENTS

| | | | |
|---|---|---|---|
| 808737 | 10/1935 | France | 417/417 |

OTHER PUBLICATIONS

*Review of Scientific Instruments,* vol. 41, No. 10, Oct. 1970, p. 1444, "Circulating Pump for High-Pressure and −200° to +400° C. Application.

*Primary Examiner*—William R. Cline
*Assistant Examiner*—Peggy A. Neils
*Attorney, Agent, or Firm*—Parkhurst & Oliff

[57] ABSTRACT

A pump utilizing a permanent magnet used for pumping fuel or lubricating oil without an electric power supply for an internal combustion engine or liquid fuel combustion equipment. This pump does not employ the conventional flexible membrane or diaphragm to pump fluid or liquid required to provide an exactly airtight construction, but utilizes a permanent magnet with high durability and inexpensive manufacturing cost for pumping liquid steadily.

10 Claims, 9 Drawing Figures

MAGNETICALLY-COUPLED RECIPROCATING PUMP

BACKGROUND OF THE INVENTION

This invention relates to a pump used for pumping fuel or lubrication oil and, more particularly, to a pump utilizing a permanent magnet without an electric power supply for pumping fuel or lubricating oil for an internal combustion engine or liquid fuel combustion equipment.

In the conventional pump of the type for pumping fluid or liquid by imparting vibration through a rocker arm or a push rod to a flexible membrane or diaphragm, it is necessary to airtightly separate the fluid section for pumping the fluid or liquid via a movable flexible diaphragm from the section for moving the diaphragm with a result that problems exist always in the airtight construction and the durability of the flexible diaphragm. In the other conventional pump of the type for vibrating a plunger by a magnetomotive force, that is, a so-called "electromagnetic or solenoid pump", problems relative to the flexible diaphragm can be avoided, however, an electric power supply is fundamentally necessary to drive the pump with expensive manufacturing cost.

SUMMARY OF THE INVENTION

It is, accordingly, a primary object of this invention to provide a pump utilizing a permanent magnet which can eliminate the aforementioned drawbacks and disadvantages of the conventional pump and can pump fluid or liquid without an electric power supply.

Another object of this invention is to provide a pump utilizing a permanent magnet which does not employ a flexible membrane or diaphragm to pump fluid or liquid in an exactly airtight construction.

Yet another object of this invention is to provide a pump utilizing a permanent magnet which incorporates high durability with inexpensive manufacturing cost.

Still another object of this invention is to provide a pump utilizing a permanent magnet which accommodates high reliability to pump liquid steadily.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
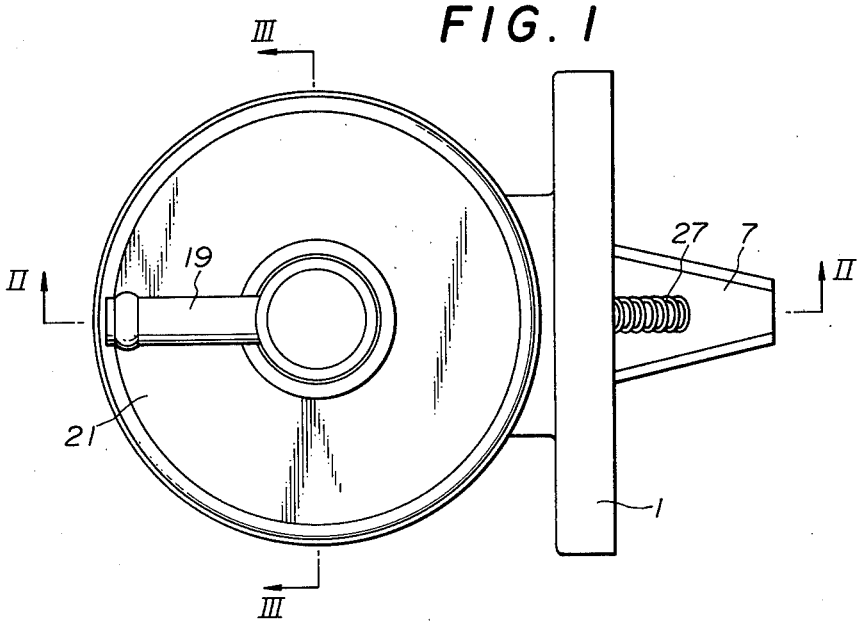
FIG. 1 is a plan view of one preferred embodiment of the pump utilizing a permanent magnet constructed according to this invention.
Figure 2:
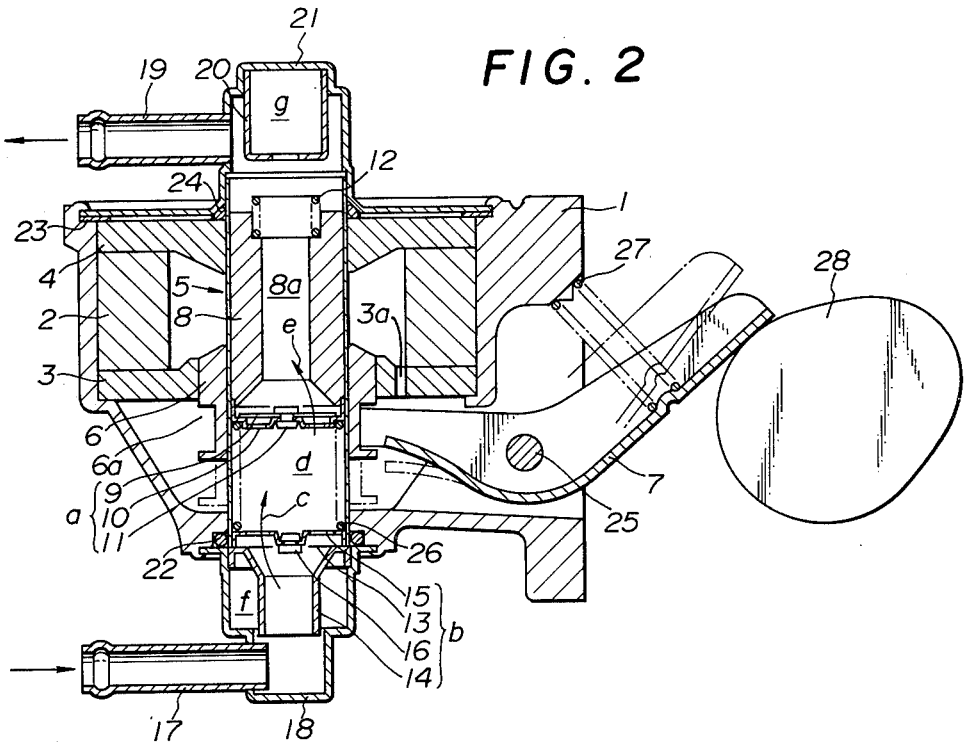
FIG. 2 is a sectional elevational view of the pump taken along the line II—II in FIG. 1.
Figure 3:
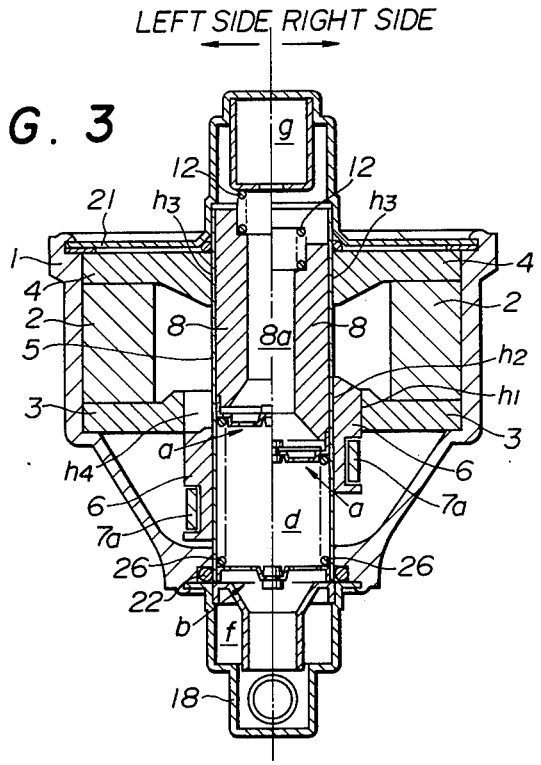
FIG. 3 is a front sectional view of the pump taken along the line III—III in FIG. 1.

Reference is now made to the drawings, and particularly to FIGS. 1 to 3 which show one preferred embodiment of the pump utilizing a permanent magnet as applied to a rocker arm type pump constructed according to this invention, but this invention is not always limited only to this embodiment.

FIG. 1 shows a plan view of one preferred embodiment of this invention, FIG. 2 shows a sectional elevational view of the pump taken along the line II—II in FIG. 1, and FIG. 3 shows a front sectional view of the pump taken along the line III—III in FIG. 1.

In FIG. 2, the pump utilizing a permanent magnet of this invention comprises a nonmagnetic body 1, a thick cylindrical permanent magnet 2 so magnetized as to incorporate opposite magnetic poles at both ends thereof, and disk-like yokes 3, 4 of magnetic material forming a magnetic circuit of the permanent magnet 2. The top and bottom surfaces of the yokes 3 and 4 respectively make close contact with the magnetic pole surfaces of the permanent magnet 2. The pump also comprises a thin nonmagnetic sleeve 5 disposed near one end thereof within the inner hole of the yoke 4 and near the other end thereof within the inner hole perforated at one end of the body 1. A vent hole 3*a* is perforated longitudinally through the yoke 3.

The pump also comprises a movable, slidably engaged thick cylindrical yoke 6 of magnetic material. On the outer periphery thereof is formed a small gap with the inner periphery of the yoke 3 at one end and the other end of the outer periphery thereof forms a groove 6*a* engaged with the fork 7*a* of a rocker arm 7.

The pump also comprises a plunger 8 of magnetic material slidably inserted into the inner periphery of the sleeve 5 in such a manner that a check valve a is fixedly secured via a valve seat 10 to one end thereof. The check valve a has a disk-like elastic thin diaphragm valve body 9, the valve seat 10, and a rivet 11 for fixing the valve body 9 to the valve seat 10 to allow fluid to flow only in the direction as designated by an arrow e. A fluid passage 8*a* is formed at the center of the plunger 8, and a stopper spring 12 is fixed to the other end of the plunger 8 for defining the position for completing the exhaust of fluid by the plunger 8.

The pump also comprises a check valve b fixed to the lower end of the sleeve 5 via a plunger spring 26 oppositely to the check valve a. The check valve b has a disk-like elastic thin diaphragm valve body 13, a valve seat 14, a holder 15 and a rivet 16.

A cap 18 having a suction tube 17 is fixed to one end of the body 1. An O-ring 22 is so provided as to airtightly seal between the body 1 and the sleeve 5 and between the body 1 and the cap 18. The check valve b allows fluid to flow in the direction as designated by an arrow c.

A pumping chamber d is defined between the check valves a and b within the sleeve 5 with the plunger spring 26 compressed internally therebetween.

A cap 21 having an exhaust tube 19 and a tube 20 is fixed to the other end of the body 1 to thereby position the location of the yokes, permanent magnet, sleeve and plunger. An O-ring 24 is so provided as to airtightly seal between the cap 21 and the sleeve 5, and a gasket 23 is so provided as to airtightly seal between the cap 21 and the body 1. The tube 20 is provided to retain fluid in a chamber g for absorbing the pulsation of liquid at the exhaust side in case that the flowing fluid is liquid and to position the location of completing the exhaust of fluid by the plunger 8.

The rocker arm 7 is rocked around a pin 25 as a center, and engaged at its one end with the groove 6*a* of the movable yoke 6 and urged at the other end by an eccentric cam 28 and a rocker arm spring 27. The pin 25 is fixed at both ends thereof to the body 1. The operation of the pump thus constructed as above will now be described in principle in detail.

The right side half portion of the pump from the center line in FIG. 3 shows the state that the movable yoke 6 is inserted by the fork 7*a* of the rocker arm 7 into the magnetic circuit having the permanent magnet 2 to thereby close the magnetic circuit. This magnetic circuit is formed by the permanent magnet 2—the yoke 3—an air gap $h_1$ (the air gap formed between the yoke 3 and the movable yoke 6)—the movable yoke 3—an air gap $h_2$ (the air gap formed between the yoke 6 and the plunger 8)—an air gap $h_3$ (the air gap formed between the plunger 8 and the yoke 4)—the yoke 4—the permanent magnet 2.

The left side half portion of the pump from the center line in FIG. 3 shows the state that the movable yoke 6 is moved out by the fork 7*a* of the rocker arm 7 from the magnetic circuit having the permanent magnet 2 to thereby open the magnetic circuit. This magnetic circuit is formed by the permanent magnet 2—the yoke 3—an air gap $h_4$ (the air gap formed between the yoke 3 and the plunger 8)—the plunger 8—the air gap $h_3$—the yoke 4—the permanent magnet 2.

The magnetic reluctance R of this magnetic circuit is proportional to the distance of the air gap formed in the magnetic circuit. The distance of the air gap h becomes as below:

$$h=h_1+h_2+h_3$$

where the magnetic circuit is closed and $$h=h_4+h_3$$

where the magnetic circuit is opened.

Since the air gap $h_4$ is much larger than the $(h_1+h_2)$, the air gap magnetic reluctance R when the magnetic circuit is opened is much larger than that when the magnetic circuit is closed.

There is the following relationship between the magnetic flux $\phi$ passing through the plunger 8 and the magnetomotive force U of the permanent magnet 2 as designated by the following formula:

$$\phi \propto (U/R)$$

When the magnetic reluctance R is varied by inserting the movable yoke 6 mechanically into the magnetic circuit and removing it thereby from the magnetic circuit, the magnetization degrees of both the plunger 8 and the movable yoke 6 are accordingly altered to thereby cause the magnetically attracting force produced between the plunger 8 and the movable yoke 6 to be altered. Since the position of the plunger 8 depends upon the balance between the magnetically attracting force acting on the plunger 8 and the repelling force of the plunger spring 26, the variation of the attracting force causes the displacement of the plunger 8 to thereby change the volume of the pumping chamber d. The check valves a and b are disposed at both ends of the pumping chamber d, and when the volume of the pumping chamber d is reduced, the check valve a is opened, while the check valve b is closed to allow the fluid in the pumping chamber d to move into the fluid pressure 8*a* in the plunger 8. On the other hand, when the volume of the pumping chamber d is increased, the check valve a is closed, while the check valve b is opened to allow the pumping chamber d to intake the fluid and to also exhaust the fluid.

A chamber f formed in the intake side of this pump and the chamber g formed in the exhaust side thereof are respectively disposed at the upstream side of the check valve b and at the downstream side of the check valve a to thus become air reservoir chambers for absorbing the pulsation of the fluid by utilizing the compressibility of the gas or air and for flowing liquid steadily when the conveying fluid is liquid.

Figure 4:
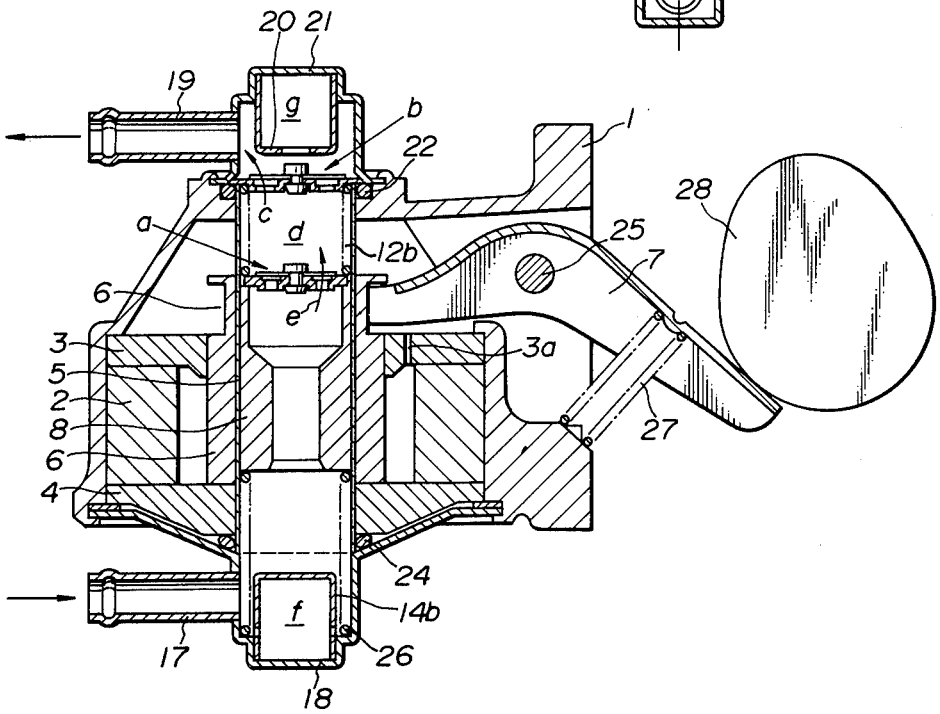
FIG. 4 is a sectional elevational view of another preferred embodiment of the pump constructed according to this invention.
Figure 5:
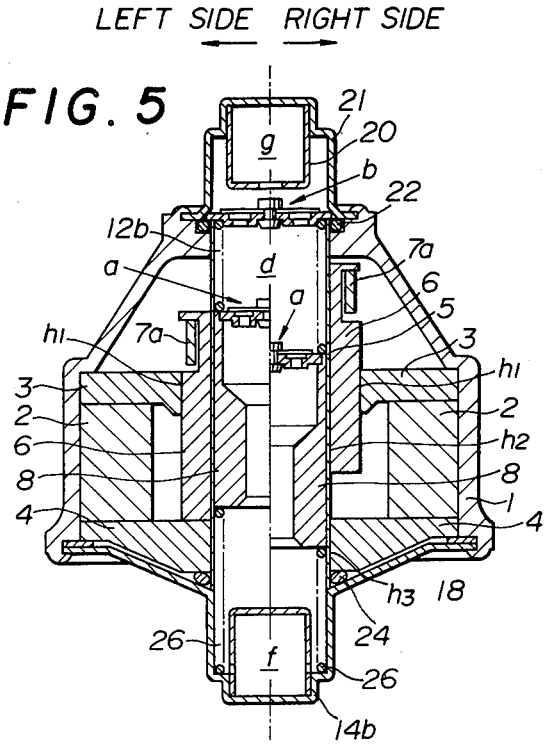
FIG. 5 is a front sectional view of the pump shown in FIG. 4.

FIGS. 4 and 5 show another preferred embodiment of the pump of this invention, and FIG. 4 shows a view similar to FIG. 2 but showing another mechanism for forming the magnetic circuit wherein like reference numerals and characters designate the same parts shown in FIGS. 1 through 3 together with the materials and the functions thereof.

Stopper spring 12*b* is disposed between the check valves a and b to control the position for completing the exhaust of the plunger 8 by means of its fully compressed state. A pipe 14*b* has a small hole formed at the lower end thereof to form a gas chamber f.

The operation of the pump thus modified in this other preferred embodiment in FIG. 4 will now be described in principle with reference to FIG. 5.

The right side half portion of the pump from the center line in FIG. 5 shows the state in which the magnetic circuit is formed by the permanent magnet 2—the yoke 3—the air gap $h_1$ (the air gap formed between the yoke 3 and the yoke 6)—the yoke 6—the air gap $h_2$ (the air gap formed between the yoke 6 and the plunger 8)—the plunger 8—the air gap $h_3$ (the air gap formed between the plunger 8 and the yoke 4)—the yoke 4—the permanent magnet 2; and the yoke 6 is separated by the fork 7*a* of the rocker arm 7 from the yoke 4.

The left side half portion of the pump from the center line in FIG. 5 shows the state in which the magnetic circuit is formed by the permanent magnet 2—the yoke 3—the air gap $h_1$—the yoke 6—the yoke 4—the permanent magnet 2; and the yoke 6 makes close contact with the yoke 4 by the fork 7*a* of the rocker arm 7.

In the former state, that is, in case that the magnetic circuit is formed with the plunger 8, there is the following relationship between the magnetic flux $\phi$ passing through the plunger 8 and the magnetomotive force U of the permanent magnet 2 as designated by the following formula:

$$\phi \propto (U/R)$$

where R is the magnetic reluctance.

Thus, the magnetically attracting force is produced between the plunger 8 and the yoke 4 to thereby cause the plunger 8 to be displaced until the force is balanced with the repelling force of the plunger spring 26.

In the latter state, that is, where the magnetic circuit is formed without the plunger 8, the magnetic flux passing through the plunger 8 becomes nearly equal to zero ($\phi \approx 0$). Since the plunger 8 is not thus magnetized, the plunger 8 is urged by the plunger spring 26 to the position of completing the exhaust.

Thus, when the yoke 6 is mechanically reciprocated to thereby change the magnetic circuit, the plunger 8 is reciprocated. Since the pumping operation produced by the reciprocating motion of the plunger 8 is the same as that produced with reference to FIG. 3, a description of it will be omitted.

Figure 6:
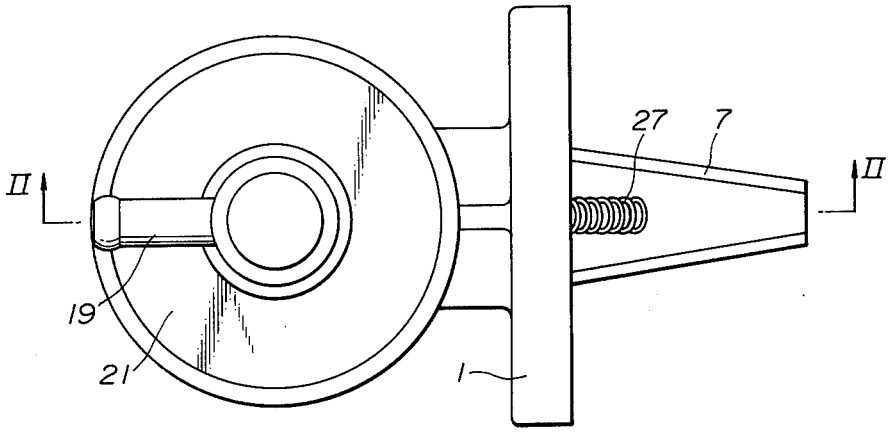
FIG. 6 is a view similar to FIG. 1 but showing yet another preferred embodiment of the pump constructed according to this invention.
Figure 7:
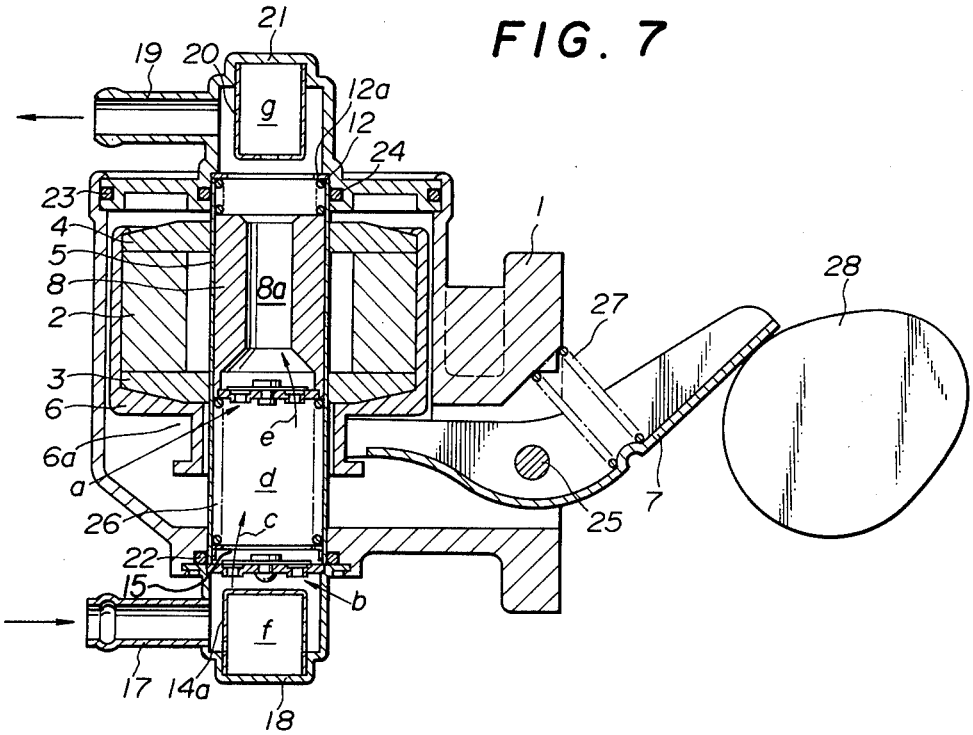
FIG. 7 is a sectional elevational view of the pump shown in FIG. 6.

FIGS. 6 and 7 show yet another preferred embodiment of the pump of this invention.

In FIG. 7, the pump utilizing the permanent magnet of this embodiment comprises a nonmagnetic body 1, a cylindrical permanent magnet 2 so magnetized as to incorporate opposite magnetic poles at both ends thereof, disk-like yokes 3, 4 having opposite side surfaces thereof making close contact with the respective opposite end magnetic pole surfaces of the permanent magnet 2, and a thin nonmagnetic cylindrical sleeve 5 on the outer periphery of which the yokes 3, 4 are slidably engaged within the inner holes thereof. The pump also comprises a nonmagnetic cylinder 6 for integrally coupling the permanent magnet 2 and the yokes 3, 4 in such a manner that the one end thereof forms a groove 6*a* engaged with the fork of a rocker arm 7 (not shown but refer to the fork 7*a* of the rocker arm 7 in FIGS. 3 and 4).

The pump also comprises within the sleeve 5 a magnetic cylindrical plunger 8, check valves a and b, a plunger spring 26, and a stopper spring 12 in such a manner that the plunger 8 is slidably inserted on the outer periphery thereof into the inner periphery of the sleeve 5. There are formed a seat 15 for the plunger spring 26 at the lower portion within the sleeve 5 and a seat 12*a* for the stopper spring 12 at the cap. Regarding the other construction, the like reference numerals designate the same parts shown in FIGS. 1 through 5, and will not accordingly be further described.

The operation of the pump thus constructed as above will now described in principle with reference to FIG. 7.

The magnetically attracting force is produced axially downwardly between the plunger 8 and the yoke 3, and is balanced with the repelling force (axially upwardly) of the plunger spring 26.

When the rocker arm 7 is rocked around the pin 25 as a center, the magnetic circuit formed by the permanent magnet 2 and the yokes 3, 4 contained within the cylinder 6 is axially reciprocated on the outer periphery of the sleeve 5 and the plunger 8 is accordingly axially reciprocated. When the cylinder 6 is moved downwardly in FIG. 7, the plunger 8 is also downwardly moved while compressing the plunger spring 26 to thereby cause the fluid in the pumping chamber d to be moved toward the passage 8*a*. When the cylinder 6 is, on the other hand, moved upwardly in FIG. 7, the plunger 8 is also upwardly moved by the repelling force of the plunger spring 26 to thereby cause the fluid in the pumping chamber d to be exhausted and the fluid to be intaken into the pumping chamber d.

Figure 8:
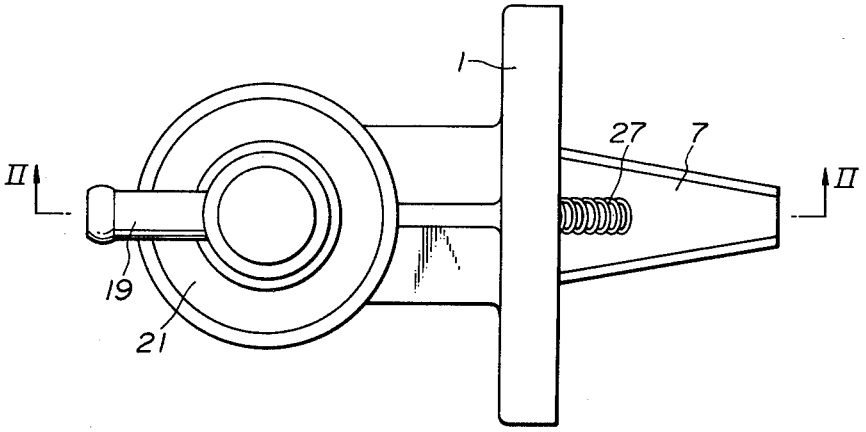
FIG. 8 is a view similar to FIG. 1 but showing still another preferred embodiment of the pump constructed according to this invention.
Figure 9:
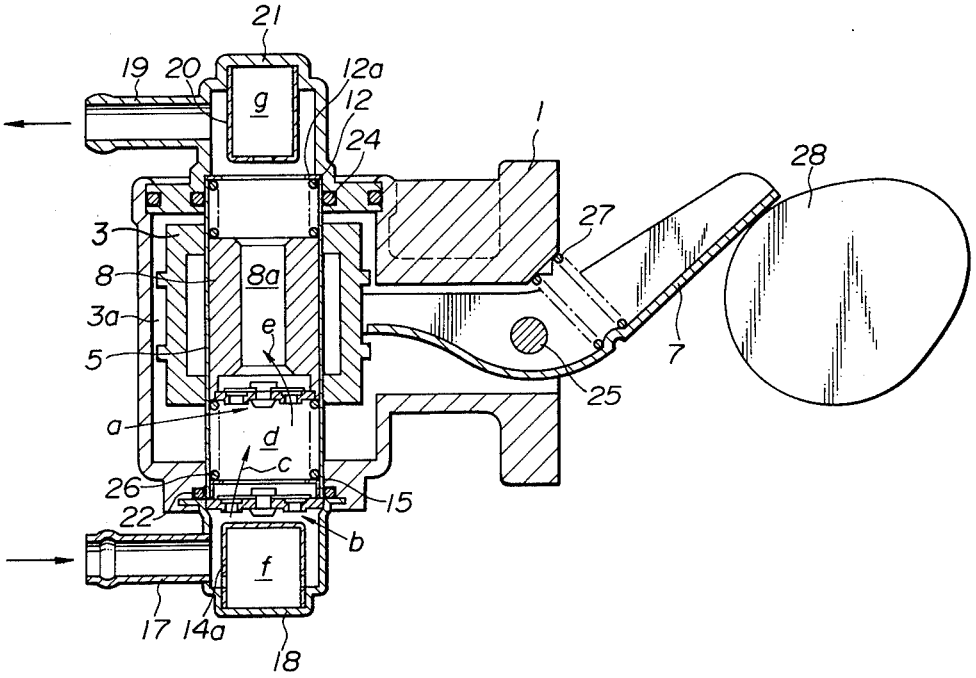
FIG. 9 is a sectional elevational view of the pump shown in FIG. 8 for describing the operation of the pump.

FIGS. 8 and 9 show still another preferred embodiment of the pump of this invention.

In FIG. 9, the pump utilizing a permanent magnet of this embodiment comprises a nonmagnetic body 1, a magnetic cylindrical yoke 3 having a groove 3*a* formed on the outer periphery thereof for engaging the fork (not shown but refer to the fork 7*a* of a rocker arm 7 in FIG. 3 or 5) of a rocker arm 7, and a thin nonmagnetic cylindrical sleeve 5 on the outer periphery of which the yoke 3 is slidably engaged within the inner hole thereof. The pump also comprises a cylindrical plunger 8 of permanent magnet slidably inserted on the outer periphery thereof into the inner periphery of the inner hole of the sleeve 5 and including a fluid passage 8*a* formed axially and so magnetized as to incorporate opposite magnetic poles at both ends thereof.

The pump also comprises within the sleeve 5 check valves a and b, a plunger spring 26, and a stopper spring 12. There are formed a seat 15 for the plunger spring 26 at the lower portion within the sleeve 5 and a seat 12*a* for the stopper spring 12 at the cap. Regarding the other construction, the like reference numerals designate the same parts shown in FIGS. 1 through 5, and will not accordingly be further described.

The operation of the pump thus constructed as above will now be described in principle with reference to FIG. 9.

The magnetically attracting force is produced axially downwardly between the plunger 8 and the yoke 3, and is balanced with the repelling force (axially upwardly) of the plunger spring 26.

When the rocker arm 7 is rocked around the pin 25 as a center, the yoke 3 is axially reciprocated on the outer periphery of the sleeve 5 and the plunger 8 of permanent magnet is accordingly axially reciprocated. When the yoke 3 is moved downwardly in FIG. 9, the plunger 8 is moved downwardly while compressing the plunger spring 26 to thereby cause the fluid in the pumping chamber d to pass through the check valve a toward the passage 8*a*. When the yoke 3 is, on the other hand, moved upwardly in FIG. 9, the plunger 8 is also upwardly moved by the repelling force of the plunger spring 26 to thereby cause the fluid in the pumping chamber d to be exhausted and the fluid to be intaken into the pumping chamber d.

As in the embodiment of FIG. 9, the permanent magnet in any embodiment of this invention may be located in the plunger rather than in the yoke.

It should be understood from the foregoing description that since the pump of this invention thus alters the magnetic flux by the operation of the rocker arm to reciprocate the plunger for pumping operation thereof, it does not necessitate an electric energy source. It should also be appreciated that since the pump of this invention does not employ a flexible membrane or diaphragm, it can be readily manufactured with high reliability.

What is claimed is:

1. A pump utilizing a permanent magnet comprising:

a sleeve disposed at the center of a nonmagnetic body, a fluid outlet and inlet provided at downstream and upstream portions of said sleeve, respectively, and an inner hole through said sleeve connecting said fluid outlet and inlet, a plunger of material capable of being magnetized slidably inserted into the inner hole of said sleeve, a plunger spring for axially urging said plunger in said sleeve in one direction, a yoke, of material capable of being magnetized, provided outside said sleeve, a permanent magnet, a fluid passage formed at the center of said plunger, downstream and upstream check valves provided within said sleeve for allowing fluid to flow in only one direction, one of said check valves being attached to said plunger, and a rocker arm mounted outside said yoke, wherein a magnetic circuit is formed within at least two of said permanent magnet, said yoke and said plunger, at least one portion of said yoke being movable with respect to the remainder of said yoke, said movable portion of said yoke contacting and being mechanically moved by said rocker arm thereby to change the magnetic reluctance of said magnetic circuit and alter the magnetic flux passing through said plunger, thereby to vary the magnetically attracting force between said plunger and said yoke to balance the magnetically attracting force with the tension of said plunger spring, thereby to conduct a pumping action at said plunger.

2. The pump according to claim 1, wherein said plunger comprises said permanent magnet and incorporates opposite magnetic poles at the ends thereof.

3. The pump according to claim 1, wherein an air reservoir chamber disposed axially of said plunger is provided to remove the pulsation of the conveying fluid caused by the pumping action.

4. The pump according to claim 1, wherein said rocker arm moves said movable yoke out of said magnetic circuit to change the magnetic reluctance of said circuit.

5. The pump according to claim 1, wherein the position of said movable yoke with respect to said at least one yoke determines whether said plunger is included in said magnetic circuit.

6. The pump according to claim 1, wherein said check valves define a chamber therebetween.

7. The pump according to claim 6, wherein said chamber is located upstream of said plunger.

8. The pump according to claim 6, wherein said chamber is located downstream of said plunger.

9. The pump according to claim 1, further comprising a stopper spring for defining the position of said plunger at the completion of an exhaust stroke of said plunger.

10. The pump according to claim 1, wherein said at least one yoke is provided with a vent hole therein.

* * * * *